US007712186B2

(12) United States Patent
Kang

(10) Patent No.: US 7,712,186 B2
(45) Date of Patent: May 11, 2010

(54) HINGE DEVICE FOR REFRIGERATOR

(75) Inventor: Dae Kil Kang, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 762 days.

(21) Appl. No.: 11/546,562

(22) Filed: Oct. 12, 2006

(65) Prior Publication Data

US 2007/0089273 A1 Apr. 26, 2007

(30) Foreign Application Priority Data

Oct. 13, 2005 (KR) ..... 10-2005-0096408

(51) Int. Cl.
*E05D 11/10* (2006.01)

(52) U.S. Cl. ..... 16/330

(58) Field of Classification Search ..... 16/330, 16/329, 328, 327, 321, 319, 303; 62/440; 312/138.1, 139, 326–329, 405; 220/264, 220/523, 262, 263
See application file for complete search history.

(56) References Cited

U.S. PATENT DOCUMENTS 5,109,571 A * 5/1992 Ohshima et al. ..... 16/307
6,065,187 A * 5/2000 Mischenko ..... 16/341
6,070,298 A * 6/2000 Sorimachi ..... 16/330
6,178,597 B1 * 1/2001 Suzuki et al. ..... 16/330
6,817,064 B2 * 11/2004 Kim et al. ..... 16/335
6,857,538 B2 * 2/2005 Lin ..... 220/830
7,055,217 B2 * 6/2006 Nishihara ..... 16/341
2004/0211211 A1 * 10/2004 Nam et al. ..... 62/440
2004/0256390 A1 * 12/2004 Nam et al. ..... 220/264
2005/0091794 A1 * 5/2005 Kang ..... 16/284
2005/0193523 A1 * 9/2005 Nam et al. ..... 16/330

* cited by examiner

*Primary Examiner*—Victor Batson
*Assistant Examiner*—Rowland D Do
(74) *Attorney, Agent, or Firm*—KED and Associates LLP

(57) ABSTRACT

A hinge for a refrigerator is disclosed. The hinge device for a refrigerator, which fastens a door thereto to open/close a storage space formed therein, includes a case having a side opened to define an exterior thereof, a case cap fastened to the case to close the opened side of the case, a rotation shaft provided within the case, the rotation shaft fastened to a side of the door to rotate together with the door, a clutch protrusion that projects outwardly from a lateral surface of the rotation shaft to have a predetermined curvature, and a clutch ring mounted within the case cap. The clutch ring is made of an elastic material and selectively contacts with the clutch protrusion to supply elasticity to the rotation shaft during the rotation thereof. The hinge device can damp an auto-closing section for closing a door of a refrigerator automatically.

15 Claims, 9 Drawing Sheets

HINGE DEVICE FOR REFRIGERATOR

This application claims the benefit of the Patent Korean Application No. 10-2005-0096408, filed on Oct. 13, 2005, which are hereby incorporated by reference as if fully set forth herein.

BACKGROUND OF THE INVENTION

1. Field of the Invention

The present invention relates to a hinge device for a refrigerator, more particularly, to a hinge device for a refrigerator which can damp in an auto-closing section for closing a door of a refrigerator automatically.

2. Discussion of the Related Art

As well-known to those skilled in the art, a refrigerator is an appliance which keeps various kinds of food fresh such as vegetables, meat, kimchi and the like. The refrigerator repeatedly performs a freezing cycle including compression, condensation, expansion and evaporation to cool an inside thereof, and controls the inside temperature to be optimal based on the kind of the stored food.

Among various kinds of refrigerators, a kimchi refrigerator classified into a draw type, a top cover type and a combination type kimchi refrigerator. The draw type kimchi refrigerator includes a storage space having a front side opened and a door drawable to take out/put the food from/into the storage space. The top cover type kimchi refrigerator includes a storage space having an upper side opened and a door rotating upwardly/downwardly to be opened/closed. The combination type kimchi refrigerator has the draw type and the top cover type combined.

For opening/closing the door of the top cover type and combination type kimchi refrigerator, a hinge device should be provided to connect the door to a body so that the door may be movable upwardly/downwardly. Accordingly, the hinge device has been studied in various methods so far.

Among the hinge devices, hinge devices are disclosed in Korean Laid-Open Patent Publication Nos. 10-2005-0043162, 10-2004-0096425, 10-2004-0073640 and 10-2003-0037377, in which a door can maintain a state of being stopped within a predetermined angle range, in other words, a free stop section: the angle between a storage space and a door is within approximately 85~20°.

As described briefly, the hinge device includes a rotation shaft, a sliding member and a compression spring. The rotation shaft is mounted within a hinge case defining an exterior of the hinge device to rotate in accordance with rotation of a door. The sliding member is provided within the case to move forwardly/backwardly and the compression spring supplies elasticity to the sliding member.

Thus, the equilibrium between the load of the door, when the door is opened/closed, and the elasticity of the compression spring is balanced so that the door is dropped by its load slowly and not closed suddenly to maintain the state of being stopped within the predetermined range of the angle.

However, the conventional hinge devices having the above configuration has a large moment in an auto-closing section, because the centroid of the door is apart from the hinge shaft in the auto-closing section in which the angle between an upper surface of the storage space and the door is 20~0°, that is, the section where the door is closely adjacent to the storage space.

Thus, since the moment is larger than the elasticity of the compression spring, there is a problem that the door might be closed by its load suddenly and strongly enough to hurt a user's hand.

To solve the above problem, the hinge devices of Korean Laid-Open Patent Publication Nos. 10-2005-0063170 and 10-2005-0089728 disclose an auxiliary damping unit such as an oil hinge and the like for using air pressure.

However, the above prior art having the above configuration has problems of high production cost as well as low work efficiency, because its structure is too complex. Also, there is another problem that the door is opened heavily when the user tries to open the door fast, because the oil hinge is always operated when he/she opens/closes the door.

Furthermore, there is still another problem that the hinge device has a short usage life, because the load of the door is not uniformly dispersed to the rotation shafts mounted to both opposite sides of the above hinge devices, but concentrated only on either of the two rotation shafts.

Still further, there is still another problem of much noise as well as unsmooth opening of the door, because the prior art hinge devices need much grease to reduce friction of the pair of cams in relative motion and the grease is carbonized by the friction.

SUMMARY OF THE INVENTION

Accordingly, the present invention is directed to a hinge device for a refrigerator.

An object of the present invention is to provide a hinge device for a refrigerator which can damp in an auto-closing section for closing a door of a refrigerator automatically.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a hinge device for a refrigerator, which fastens a door thereto to open/close storage space formed therein, includes a case having a side opened to define an exterior thereof; a case cap fastened to the case to close the opened side of the case; a rotation shaft provided within the case, the rotation shaft fastened to a side of the door to rotate together with the door; a clutch protrusion projected outwardly from a lateral surface of the rotation shaft to have a predetermined curvature; a clutch ring mounted within the case cap, the clutch ring made of elastic material so that the clutch ring is selectively contacted with the clutch protrusion to supply elasticity to the rotation shaft during the rotation of the rotation shaft.

Here, a contact part is recessed inwardly on both opposite sides of the clutch ring to be spaced apart a predetermined distance from an inner surface of the case cap so that the clutch protrusion is selectively contacted with the contact part.

The hinge device for a refrigerator further includes a compression spring provided within the case to supply elasticity for damping the rotation shaft in a predetermined section to the rotation shaft.

Also, the clutch protrusion starts the contact with the clutch ring in an auto-closing section where the door is closed due to the load of the door larger than the elasticity the compression spring supplies.

Meanwhile, the elasticity of the compression spring balances equilibrium with the load of the door in a free-stop section where the door keeps on being stopped when it rotates upwardly/downwardly to be opened/closed.

The hinge device for a refrigerator further includes a sliding member provided within the case, with both opposite sides thereof contacted with the rotation shaft and the compression spring respectively, to move forwardly/backwardly.

At that time, a sliding recess is formed on an inner surface of the case in a longitudinal direction to guide the forward/backward motion of the sliding member, and a sliding protrusion corresponding to the sliding recess is projected on the sliding member.

Furthermore, a sliding cam is projected on an inner surface of the sliding member so that the sliding member moves forwardly/backwardly due to the relative motion by the contact with the rotation shaft, and a shaft cam corresponding to the sliding cam is provided in a side of the rotation shaft.

The rotation shaft and the sliding member are made of injection lubricative material which contains lubricant when being injection-molded.

The pairs of the compression springs, the sliding members and the rotation shafts are arranged in both opposite sides from the center of the case, respectively.

Also, an engaging protrusion contacted with each inner surface of the case and the case cap is projected outwardly on an outer surface of the rotation shaft.

Here, a rotation supporting part is extended in a shaft direction from a center of the rotation shaft so that the rotation shaft may not be eccentric when rotating.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
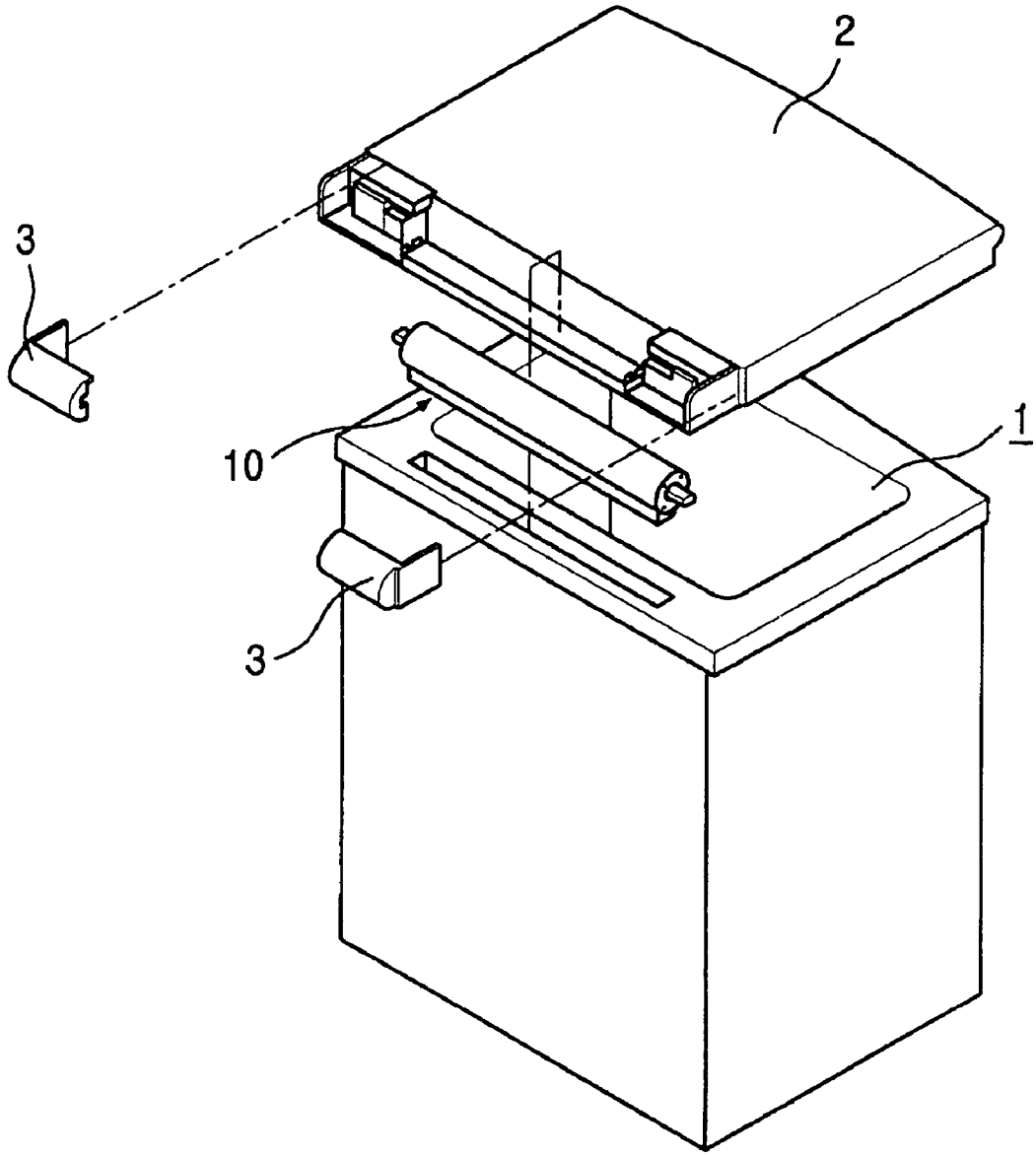
FIG. 1 is an exploded perspective view illustrating a door of a refrigerator having a hinge device according to the present invention fastened thereto.

FIG. 1 is an exploded perspective view illustrating a fastening structure of a door for a refrigerator having a hinge device according to the present invention. As shown in FIG. 1, a storage space 1 having an upper side opened is formed within a body of the refrigerator and the upper side of the storage space 1 is opened/closed by a door 2.

A hinge device 10 is mounted to a rear surface of the door 2 and a rear end of the body. The hinge device 10 is rotatable upwardly/downwardly, and both opposite side ends thereof are fixed to a rear surface of the door 2 and a lower end there of is fixed to a rear end of an upper surface of the body.

An auxiliary cover member 3 is mounted in both sides of the rear surface of the door 2, where the hinge device 10 and the door 2 are fastened, to open/close the fastening portion between the hinge device 10 and the door 2.

Figure 2:
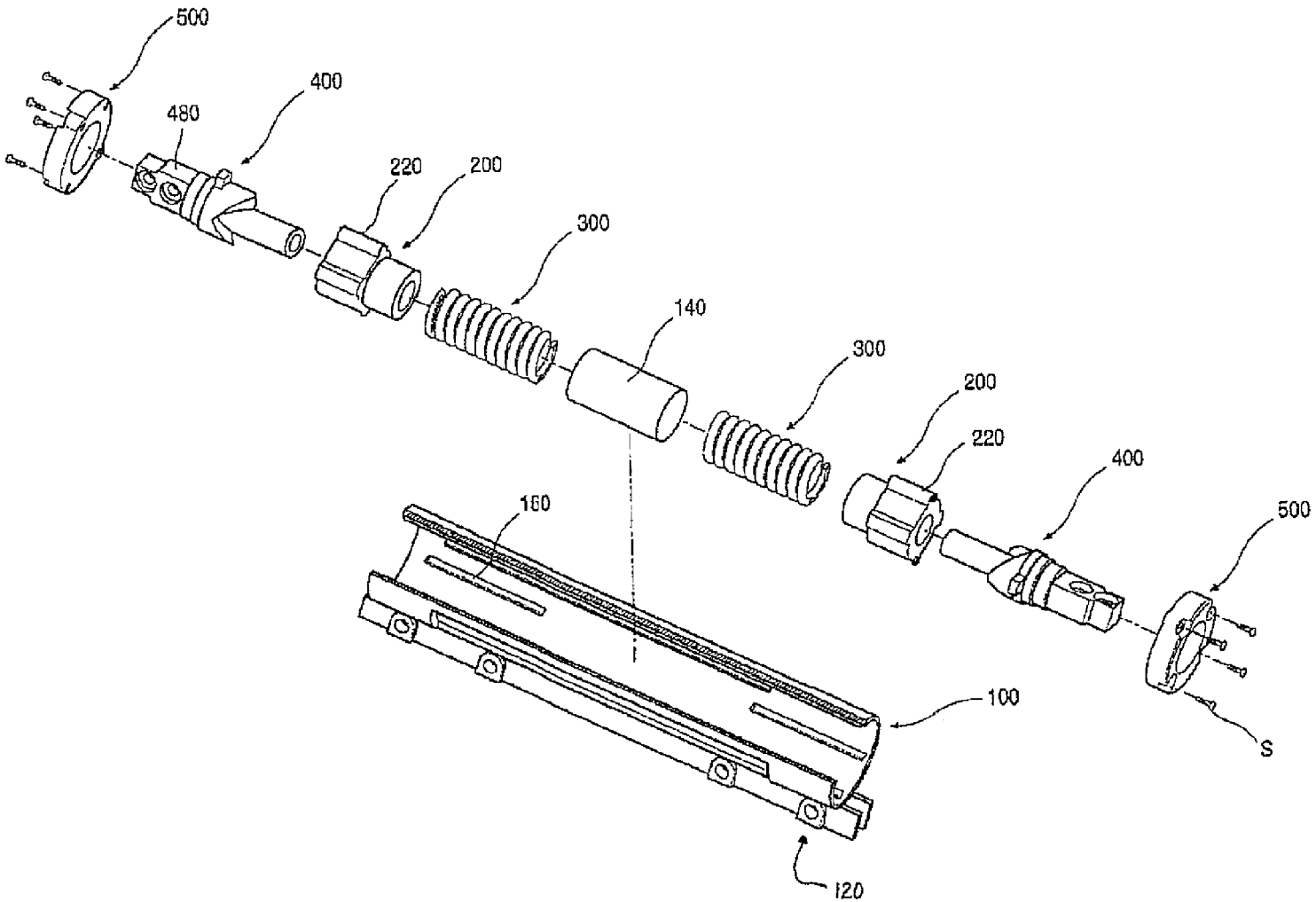
FIG. 2 is an exploded perspective view of the hinge device according to the present invention.
Figure 3:
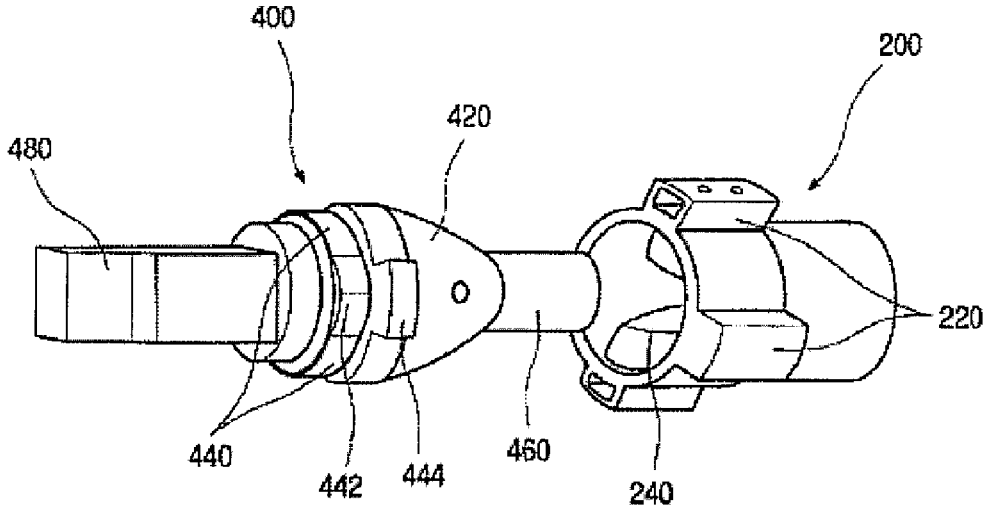
FIG. 3 is a perspective view illustrating a fastening structure between a rotation shaft and a sliding member, which are key parts of the hinge device according to the present invention.

Referring to FIGS. 2 and 3, the hinge device 10 will be described in detail.

FIG. 2 is an exploded perspective view illustrating the structure of the hinge device for a refrigerator according to the present invention and FIG. 3 is an exploded perspective view illustrating a fastening structure between a rotation shaft and a sliding member, which are key parts of the hinge device according to the present invention. As shown in FIGS. 2 and 3, the hinge device 10 includes a case 100, a compression spring 300, a sliding member 200, a rotation shaft 400, and a case cap 500.

The case 100 defines an exterior of the hinge device 10 and is formed in a cylindrical shape having both sides opened. A fastening part 120 is extended downwardly and perpendicularly from a lower portion of the case 100 to be seated on a rear end of the upper surface of the body.

A supporting part 140 of a cylindrical shape having a smaller inner diameter than the inner diameter of the case 100 is provided in a center of the case 100 to support a terminal end of the compression spring 300.

Also, a sliding recess 160 is formed on an inner circumferential surface of the case 100 in a longitudinal direction to guide a forward/backward motion of the sliding member 200, which will be described later. The shape and number of the sliding recess 160 is corresponding to those of a sliding protrusion 220 of the sliding member 200, and the length of the sliding recess 160 is the same as that of the section where the sliding member 200 moves forwardly/backwardly.

The compression spring 300 is symmetrically provided in both opposite sides of the case 100 to supply elasticity to the sliding member 200. The both lateral ends of the compression spring 300 are contacted with an end of the supporting part 140 and an end of the sliding member 200, respectively.

At that time, the elasticity of the compression spring 300 is corresponding to the load of the door 2 so that the door 2 may maintain the state of being stopped in a free-stop section (A) which will be described later.

The pair of sliding members 200 is provided in both opposite sides of the case 100 in symmetry. The sliding member 200 moves forwardly/backwardly within the case 100 and a first end thereof is contacted with the compression spring 300 to receive elasticity from the compression spring 300 when the compression spring 300 is extended or contracted.

An outer part of the sliding member 200 is corresponding to the sliding recess 160 to have a sliding protrusion 220 projected thereon. Due to the fastening between the sliding recess 160 and the sliding protrusion 220, the sliding member 200 can move forwardly/backwardly within the case 100 in a state where the rotation thereof is limited.

For the safe forward/backward motion of the sliding member 200, it is preferred that at least three sliding recesses 160 and sliding protrusions 220 are formed the same predetermined distance, and the sliding protrusion 220 and the sliding recess 160 may be alternated as necessary.

A sliding cam 240 is provided on an inner surface of the sliding member 200 so that the sliding cam 240 relative-moves forwardly/backwardly due to the contact with the rotation shaft 400, and the sliding cam 240 is projected along the inner surface of the sliding member 200 to form a spiral shape or an oblique.

Hence, the rotation shaft 400 is mounted to an outer portion of the sliding member 200. The rotation shaft 400 transmits the rotational motion of the door 2 to the sliding member 200, and a first side thereof is fixed to the door 2 and a second side thereof is contacted with the sliding member 200.

A shaft cam 420 is formed on the first side of the rotation shaft 400, with which the sliding member 200 is contacted, to transmit the rotational motion of the rotation shaft 400 to the rotation shaft 400 and the appearance of the shaft cam 420 is corresponding to that of the sliding cam 240.

Thus, when the rotation shaft 400 is rotated in a state where the sliding cam 240 and the shaft cam 420 are contacted each other, the sliding member 200, of which rotation is limited, moves forwardly/backwardly due to the mutual operation of the shaft cam 420 and the sliding cam 240.

The above appearance and structure of the shaft cam 420 and the sliding cam 240 may be variously applicable to those skilled in the art and the detailed description thereof will be omitted.

The sliding member 200 and the rotation shaft 400 are made of injection-mold lubricative material which contains lubricant when being injection-molded. Accordingly, efficient lubricative function may be performed without additional lubricant such as grease and the like.

Meanwhile, the case cap 500 is mounted on both opened sides of the case 100 and fastened to the case 100 by an auxiliary screw (S) to open/close the both opposite sides of the opened surface of the case 100 as well as to fix the rotation shaft 400 from being detached.

Figure 4:
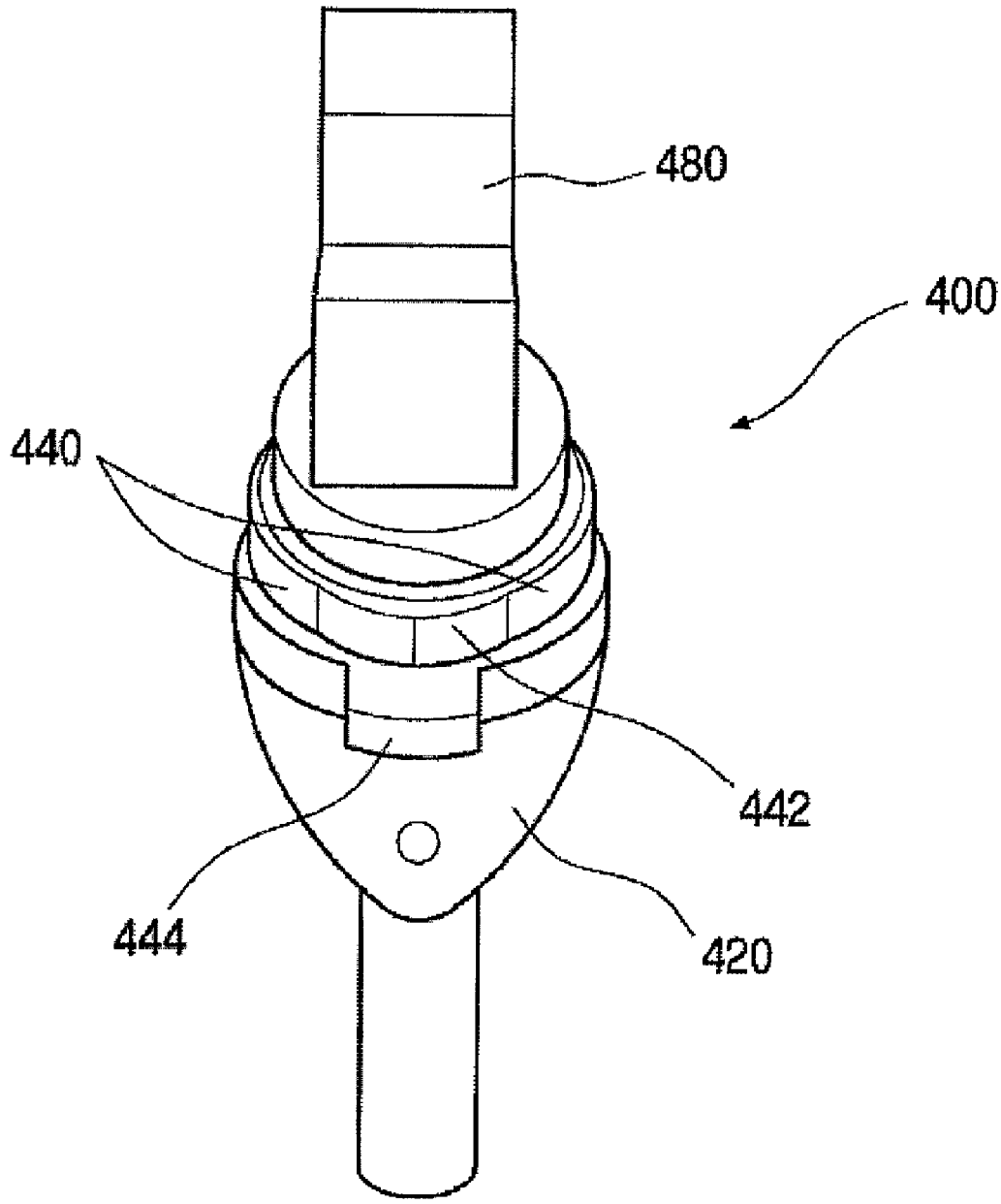
FIG. 4 is a perspective view illustrating an exterior of the rotation shaft, which is one of the key parts of the hinge device according to the present invention.

FIG. 4 is a perspective view illustrating an exterior of the rotation shaft. Referring to FIG. 4, the rotation shaft 400 will be described in detail.

The rotation shaft 400 has a skirt part 440 projected from a center thereof in a radial shape to be held within a holding part 520 of the case cap 500, which will be described later.

A clutch protrusion 442 is formed on an outer circumferential surface of the skirt part 440 in symmetrically pairs. The clutch protrusion 442 is selectively contacted with a side of the inner circumferential surface of the case cap 500 in a predetermined section, and projected outwardly from an outer surface of the skirt part 440 to have a predetermined curvature.

Thus, the clutch protrusion 442 is projected outwardly from the skirt part 440 of the rotation shaft 400 and may be selectively contacted with the inner surface of the case cap 500 in accordance with the rotation of the rotation shaft 400.

Alternatively, the clutch protrusion 442 may be made of metal having abrasion resistance, which is different from the material of rotation shaft 400, not to be abraded by the consistent contact with the case cap 500, and then may be mounted to an outer portion of the skirt part 440.

An engaging protrusion 444 is projected outwardly from a lower portion of the skirt part 440 to be contacted with a surface of the case cap 500. The engaging protrusion 444 prevents the rotation shaft 400 from being detached and helps the rotation shaft 400 to rotate safely, and projected to be contacted with the inner circumferential surface of the case 100.

A rotation supporting part 460 is projected from an end of the rotation shaft 400 in a longitudinal direction so that the rotation shaft 400 may be rotated without being eccentric. The rotation supporting part 460 is extended from the center of the skirt part 440.

An outer diameter of the rotation supporting part 460 is corresponding to an inner diameter of the sliding member 200 in the position where the sliding cam 240 is formed. Hence, the rotation supporting part 460 is inserted in the sliding member 200 to help the safe rotation of the rotation shaft 400.

A shaft fastening part 480 is formed on the other end of the rotation shaft 400. The shaft fastening part 480 is extended from a side of the skirt part 440 so that the rotation shaft 400 fastened to a side of the door 2 may rotate together with the door 2.

When the case cap 500 is fastened to the case 100, the shaft fastening part 480 passes through the case cap 500 and is extended outside in a predetermined length. Preferably, the shaft fastening part 480 is in a square column shape or a square piece.

Figure 5:
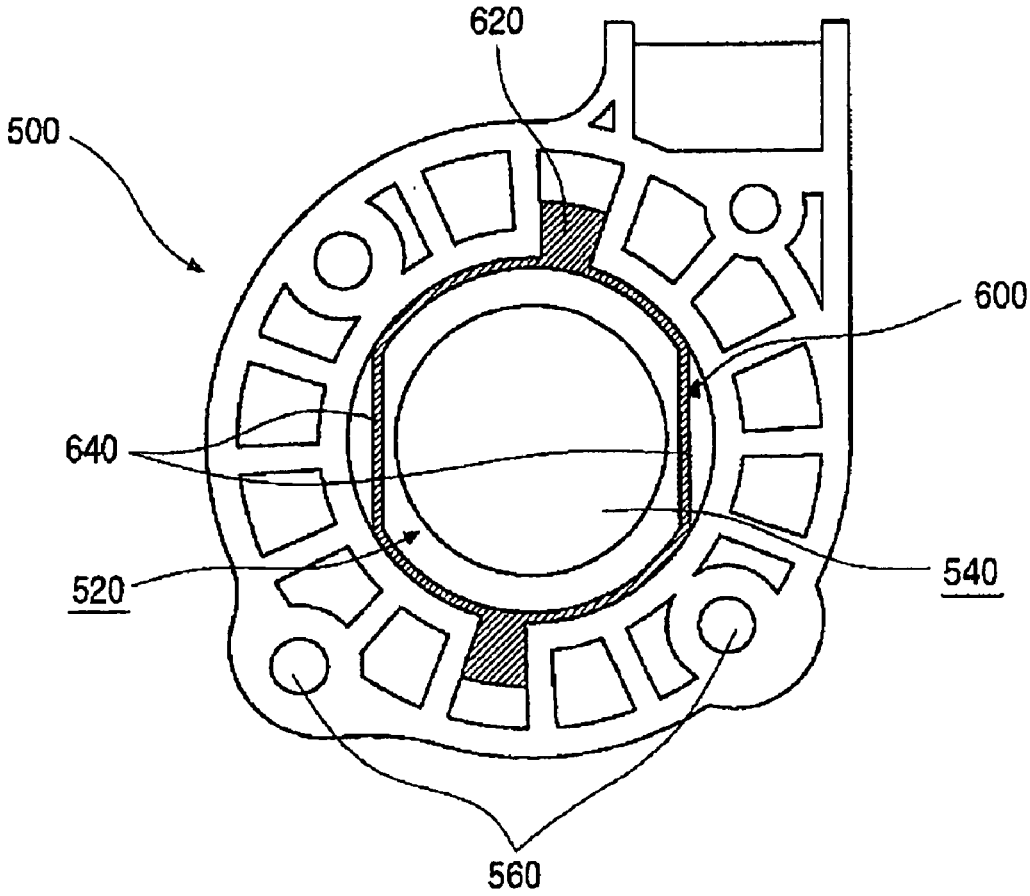
FIG. 5 is a sectional view illustrating an exterior of a case cap, which is also one of the key parts of hinge device according to the present invention.

Next, FIG. 5 is a sectional view illustrating an exterior of a case cap, which is also one of the key parts of hinge device according to the present invention. Referring to FIG. 5, the case cap 500 will be described in detail.

As shown in FIG. 5, the shape of case cap 500 is corresponding to the shape of the side section of the case 100, and a through-hole 540 is formed in a center of the case cap 500 to pass the shaft fastening part 480 of the rotation shaft 400 there through.

The through-hole 540 is corresponding to the shaft fastening part 480 or to the end of the skirt part 440 having the shaft fastening part 480 formed thereon, and a holding part 520 is formed in a rear portion of the through-hole 540, which has a larger inner diameter than an inner diameter of the through-hole 540.

The holding part 520 holds the skirt part 440 of the rotation shaft 400 and has a larger outer diameter than an outer diameter of the skirt part 440, such that the skirt part 440 held within the holding part 520 can rotate smoothly.

Thus, when the case cap 500 is fastened to the case 100, the shaft fastening part 480 of the rotation shaft 400 passes through the through-hole 540 to be exposed outside and the skirt part 440 is held within the holding part 520. Here, the terminal end of the skirt part 440 is contacted with the inner surface of the holding part 520 and the engaging protrusion 444 is contacted with the inner surface of the case cap 500.

In addition, plural screw holes 560 are formed on an outer portion of the case cap 500 and the case cap 500 is fastened to the side of the case 100 by the screw (S) passing through the screw hole 560.

Meanwhile, the clutch ring 600 is mounted within the holding part 520 of the case cap 500. The clutch ring 600 is inserted to be selectively contacted with a lateral surface of the rotation shaft 400 so that the rotation of the rotation shaft 400 is limited in a predetermined section.

The clutch ring 600 is formed in a ring shape having the width corresponding to the recessed depth of the holding part 520 and includes a fixing part 620 projected outwardly to prevent the clutch ring 600 from idling within the holding part 520. Preferably, at least one fixing part 620 is inserted in the recessed portion of the holding part 520.

A contact part 640 is formed on both opposite sides of the clutch ring 600. The contact parts 640 are inwardly recessed from the both opposite sides of the clutch ring 600 to be selectively contacted with the clutch protrusion 442 of the skirt part 440 held in the holding part, respectively.

That is, the contact part 640 is recessed inwardly on some portion of both opposite sides of the clutch ring 600 in a shape rather than a cylindrical shape of the clutch ring 600 and the contact parts 640 are horizontally arranged each other.

Thus, in case that the clutch ring 600 is mounted to the holding part 520, the outer circumferential surface of the clutch ring 600 except the contact part 640 is closely contacted with the inner circumferential surface of the holding part 520, and the contact part 640 is spaced apart from the inner circumferential surface of the holding part 520.

At that time, the distance between the contact parts 640 is narrower than the distance between the clutch protrusions 442 so that the clutch protrusion 442 is contacted with the contact part 640 in a predetermined section when the skirt part 440 is rotated.

Since the clutch ring 600 is made of plastic or metal, which has predetermined elasticity, and pushed outwardly when contacted with the clutch protrusion 442. The elasticity generated at that time pushes the rotation shaft 400 and limits the rotation of the rotation shaft 400.

Meanwhile, preferably, the contact part 640 starts the contact with the clutch protrusion 442 when the door 2 is positioned in an auto-closing section (B), where the angle between the upper surface of the storage space and the door 2 is 20~0°.

Next, the operation of the hinge device for a refrigerator having the above configuration will be described referring to the door.

Figure 6:
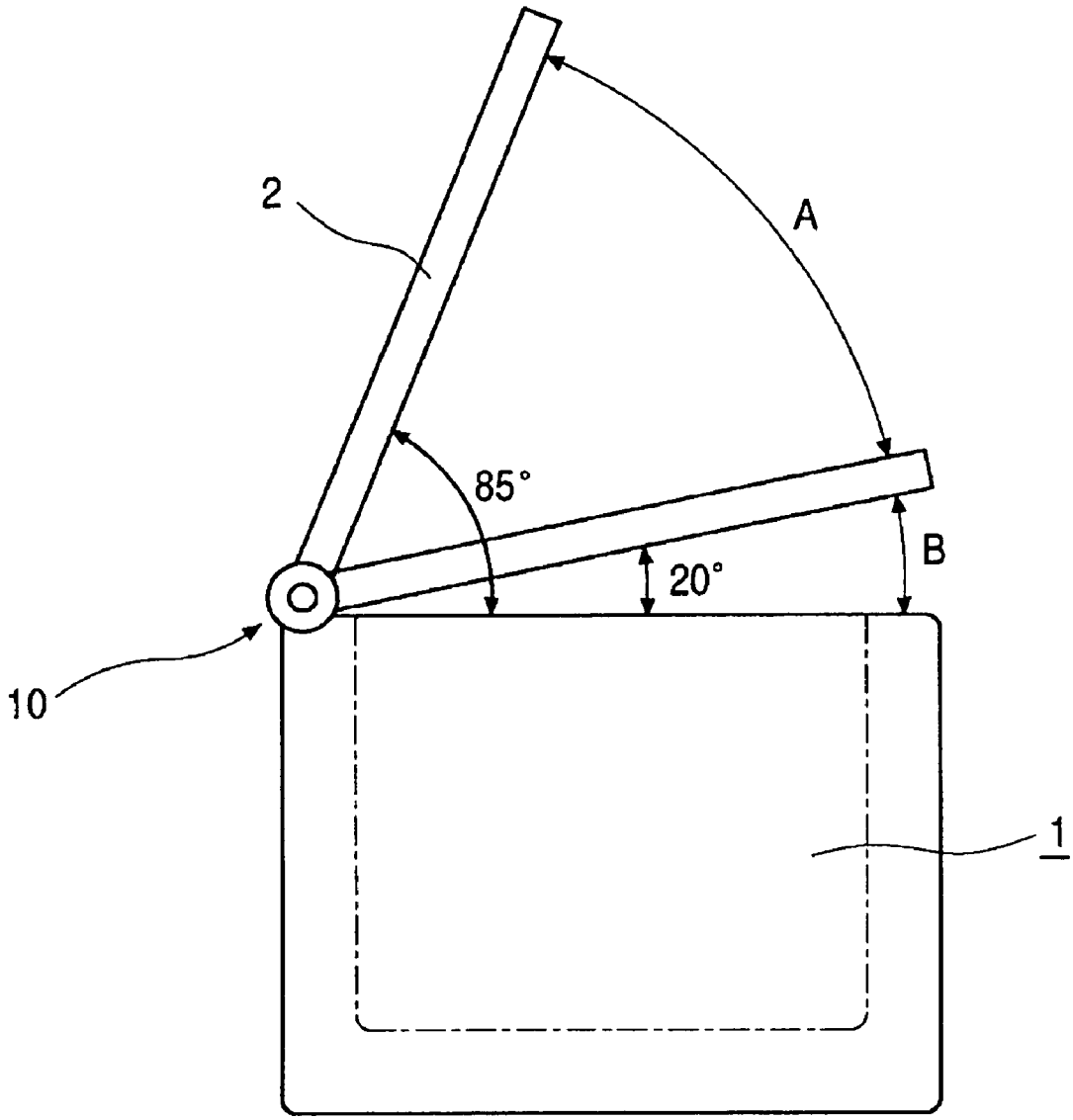
FIG. 6 is a side view schematically illustrating a state where the door of the refrigerator having the hinge device fastened thereto is opened/closed.

FIG. 6 is a side view schematically illustrating a state where the door of the refrigerator having the hinge device fastened thereto is opened/closed. As shown in FIG. 6, a user rotates the door 2 upwardly/downwardly to selectively open/close the storage space 1 of the refrigerator.

When the door 2 is rotated, the section where the door 2 is rotated is divided into a free-stop section (A) and an auto-closing section (B).

In the free-stop section (A), the load of the door 2 balances equilibrium with the elasticity of the compression spring 300, and when the door 2 is rotated upwardly/downwardly the door 2 can maintain the state of being stopped. The angle between the upper surface of the storage space 1 and the door 2 is 85~20° in the free-stop section (A).

In the auto-closing section (B), the load of the door 2 is larger than the elasticity of the compression spring 300 and the door 2 is closed fast by its load in case that an additional damping part is not provided. In the auto-closing section (B), the angle between the upper surface of the storage space 1 and the door 2 is 20~0°.

Next, the damping operation in the auto-closing section (B) will be described in detail, referring to FIGS. 7 and 8.

Figure 7:
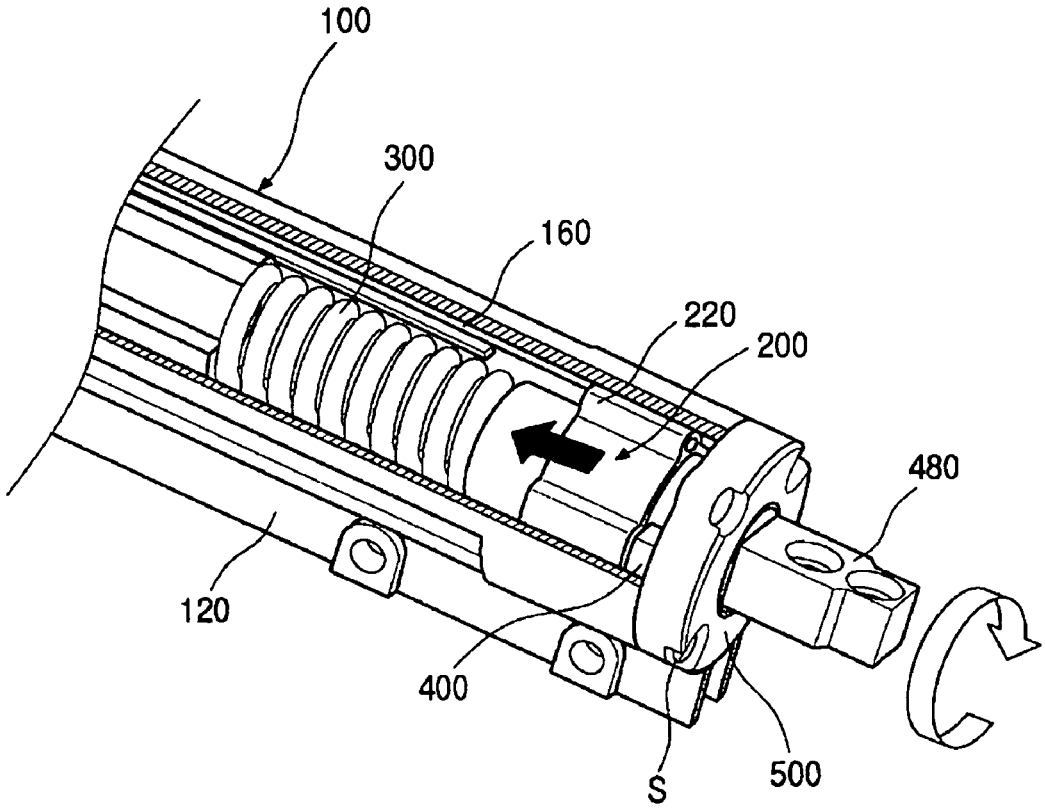
FIG. 7 is a partially cut-away perspective view illustrating an inside of the hinge device when the door of the present invention is closed.
Figure 8:
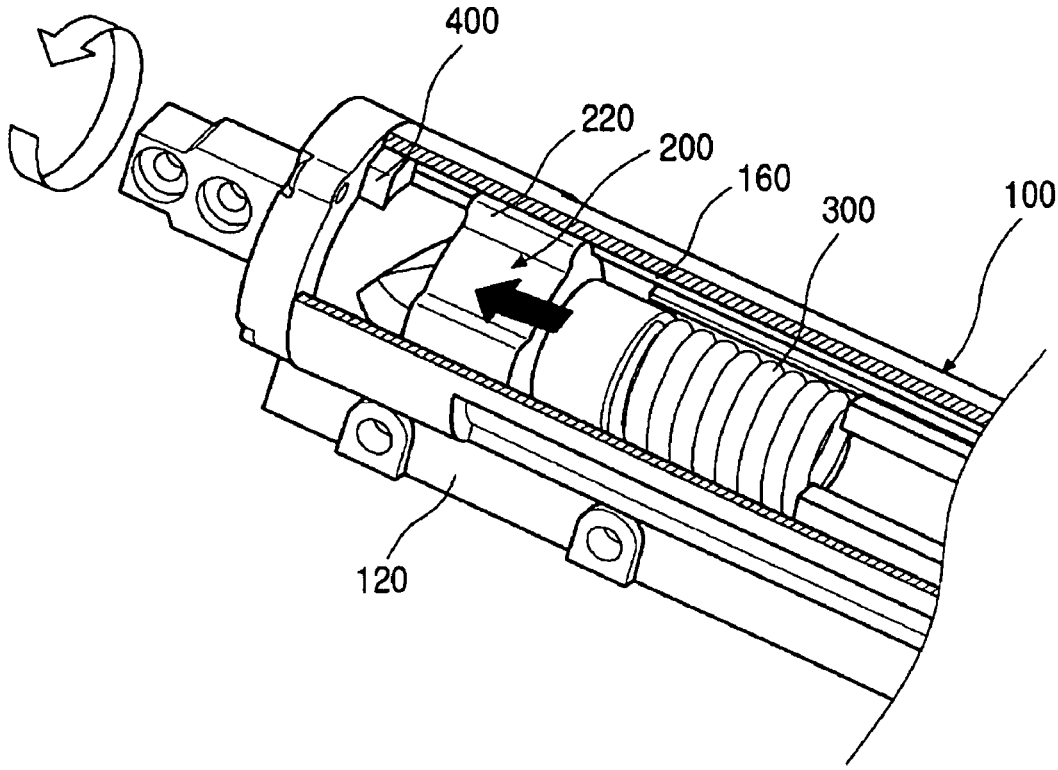
FIG. 8 is a partially cut-away view illustrating the inside of the hinge device when the door of the present invention is opened.

FIG. 7 is a partially cut-away perspective view illustrating an inside of the hinge device when the door of the present invention is closed and FIG. 8 is a partially cut-away view illustrating the inside of the hinge device when the door of the present invention is opened.

As shown in FIGS. 7 and 8, when the door 2 is totally opened, that is, the angle between the upper surface of the storage space 1 and the door 2 is 85°, the inclined surfaces of the sliding cam 240 and the shaft cam 420 are completely contacted with each other in a state where the sliding member 200 and the rotation shaft 400 are fastened each other.

Hence, the sliding member 200 is positioned on the end of the case 100 by the elasticity of the compression spring 300. The above compression and the load of the door 2 is the same to maintain the state of the door 2 being opened.

Once the user rotates the door 2 slowly in a downward direction, the rotation shaft 400 fastened to the side of the door 2 rotates together with the door 2. The rotational power is transmitted to the sliding member 200 contacted with the rotation shaft 400. But, the sliding member 200 is not rotated, because the rotational motion of the sliding member 200 is limited by the fastening between the sliding protrusion 220 and the sliding recess 160.

Thus, the shaft cam 420 of the rotation shaft 400 is moving along the inclined surface, contacted with the sliding cam 240 of the sliding member 200. Hence, the rotation shaft 400 is controlled not to move outwardly, so that the sliding member 200 moves inwardly.

Due to the motion of the sliding member 200 the compression spring 300 is compressed, and that elasticity of the compression spring 300 is transmitted to the rotation shaft 400, especially in a counter direction of the rotation of the rotation shaft 400.

At that time, the transmitted elasticity is the same to be horizontal with the load of the door 2. Thereby, even when the rotation of the door 2 is stopped, the door is stopped in a state of being opened.

When the door 2 is continuously rotated in a down direction, the sliding cam 240 and the shaft cam 420 are in relative motion consistently to push the sliding member 200 inwardly. Thus, the compression spring 300 is compressed and accordingly the elasticity of a clockwise/counter-clockwise direction can be supplied to the rotation shaft 400.

Once the door 2 is downwardly rotated to reach 20° of the angle with the upper surface of the storage space 1, the end of the sliding cam 240 is contacted with the end of the shaft cam 420, such that the sliding member 200 cannot be pushed inwardly.

Thus, since the elasticity of the compression spring 300 is not increasing any more, the door 2 is rotated downwardly by its load to be closed and the damping operation of the compression spring 300 may not be expected.

Next, the damping operation of the auto-closing section (B) will be described in detail, referring to FIG. 9.

Figure 9:
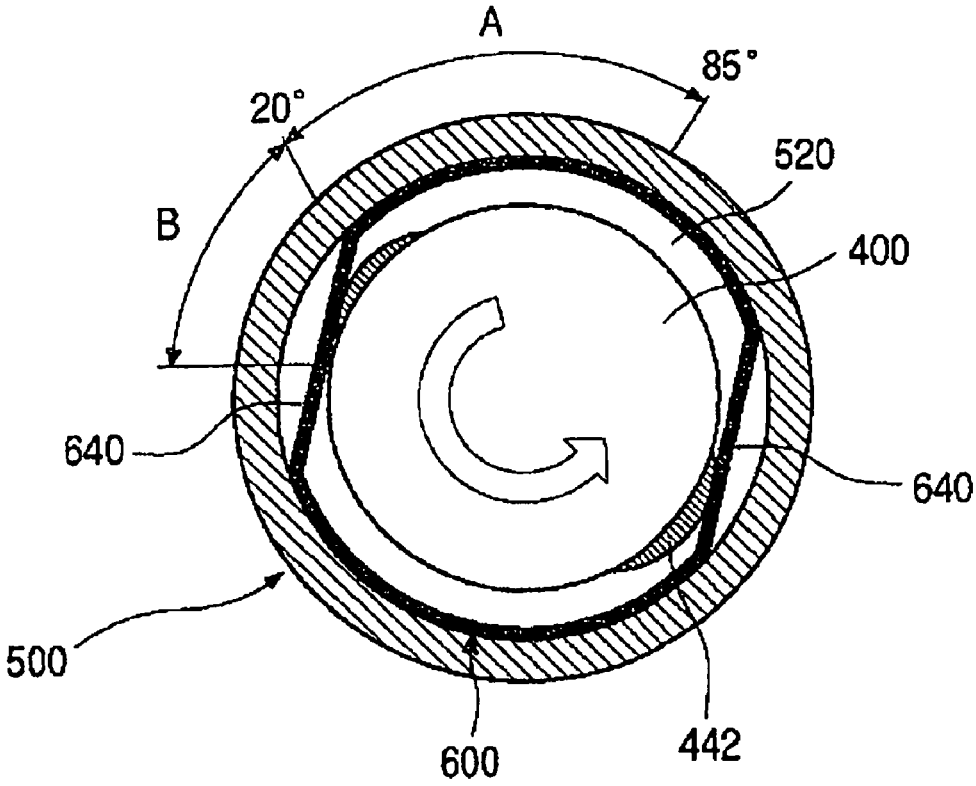
FIG. 9 is diagram schematically illustrating the state of clutch protrusion and clutch ring due to the rotation of the door according to the present invention.

FIG. 9 is a diagram schematically illustrating the state of clutch protrusion and clutch ring due to the rotation of the door according to the present invention. As shown in FIG. 9, the door 2 passes the free-stop section (A) into the auto-closing section (B) when the door 2 is consistently rotated in a downward direction.

When the door 2 is rotated in the free-stop section (A), the rotation of the rotation shaft 400 is limited by only the compression spring 300 in a state of not being contacted with the side of the rotation shaft 400 held within the holding part 520 of the case cap 500 but the rotation shaft 400 may be rotated freely without any limitation caused by the inside of the holding part 520.

Whereas, when the door 2 is getting into the position of the angle 20° between the upper surface of the storage space 1 and the door 2, the side of rotation shaft 400, held within the holding part 520 of the case cap 500, starts the contact with the inside of the holding part 520.

More specifically, at the moment that the door 2 is getting into the auto-closing section (B), the clutch protrusion 442, projected outwardly from the skirt part 440 of the rotation shaft 400 which rotates together with the door 2, starts the contact with the contact part 640 of the clutch ring 600.

Once the door 2 is continuously rotated in a downward direction, the rotation shaft 400 is rotated in a counter-clockwise direction, seen from FIG. 9, and compresses the contact part 640 of the clutch ring 600 contacted with the clutch protrusion 442 of the rotation shaft 400.

At that time, since the clutch ring 600 is made of elastic material and the contact part 640 is spaced apart a predetermined distance from the inner surface of the holding part 520, the clutch protrusion 442 compresses the contact part 640 with pushing it outwardly.

Also, the clutch protrusion 442 is projected to have a predetermined curvature. Thus, the more the rotation shaft 400 rotates in a counter-clockwise direction, the more strongly the clutch protrusion 442 compresses the contact part 640. Thereby, a predetermined elasticity may be generated in the contact part 640 and the elasticity is resistant against the rotation of the rotation shaft 400.

That is, since the elasticity of the contact part 640 is getting larger in accordance with the downward rotation of the door 2 due to the characteristic of its appearance, the elasticity, which is gradually increasing as the door 2 is gradually closing, is transmitted to the rotation shaft 400 to limit the rotation of the rotation shaft 400.

Meanwhile, the elasticity generated in the contact part 640 is smaller than the load of the door 2 to operate damping operation for slowly closing the door 2 due to its load.

Even when the door 2 is rotated upwardly to be opened, the door 2 is dampened by the elasticity of the contact part 640 of the compression spring 300 in the same section as the downward rotation of the door 2.

Thus, in upward/downward rotation of the door 2 to be opened/closed according to the hinge device 10, the rotation of the rotation shaft 400 is limited by the elasticity of the compression spring 300 so that the door 2 may maintain equilibrium or be dampened when the door 2 is rotated in the free-stop section (A). The rotation of the rotation shaft 400 is limited by the elasticity of the contact part 640 to damp the door 2 when the door 2 is rotated in the auto-closing section (B).

As mentioned above, the hinge device for a refrigerator according to the present invention has following advantageous effects.

First, when the door is rotated, the door is dampened or maintains equilibrium by the elasticity of the compression spring in the free-stop section, and the door is dampened in the auto-closing section by the elasticity of the contact part operated only in the auto-closing section.

Thus, since the door may be dampened in all the section when opened/closed, the use of the door may be convenient and accidents caused when opening/closing the door may be prevented. Thereby, the hinge device of the present invention has an advantageous effect of improved user convenience and safety.

Second, since both opposite sides of the hinge device according to the present invention are arranged in symmetry and the moment generated in the rotation of the door is supported uniformly in both sides thereof, damage of the door or of the hinge device may be prevented and durability thereof may be enhanced.

Third, since the hinge device of the present invention has a simpler structure, compared with the structure using an auxiliary oil hinge or torsion spring, production cost may be reduced and work efficiency may be enhanced.

Fourth, since the hinge device of the present invention uses elasticity generated by the contact between the contact part of the clutch ring and the clutch protrusion, fast rotation of the door is possible when the door is upwardly rotated to be opened and the door may be opened smoothly to maximize user's convenience.

Finally, since the sliding member and the rotation shaft, which relative-moves in contact with each other, are made of injection-molding lubricative material, efficient lubrication is possible without grease. Thus, noise, which might be generated by carbonization of grease, may be prevented to relieve user's complaint.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A hinge device for a refrigerator, which fastens a door thereto to open/close storage space formed therein, the hinge device comprising:

a case having a side opened to define an exterior thereof;

at least one case cap fastened to the case to close the opened side of the case, the at least one case cap comprising a holding part recessed inwardly by a predetermined depth;

at least one rotation shaft provided within the case, the at least one rotation shaft being fastened to a side of the door to rotate together with the door;

a clutch protrusion that projects outwardly from a lateral surface of the at least one rotation shaft and having a predetermined curvature; and a clutch ring mounted within the case cap, the clutch ring being formed in a ring shape having a width corresponding to the recessed depth of the holding part and being made of an elastic material so that the clutch ring selectively contacts with the clutch protrusion to supply elasticity to the at least one rotation shaft during the rotation of the at least one rotation shaft, wherein the clutch ring comprises a contact part recessed away from an inner surface of the case cap on opposite sides of the clutch ring and spaced apart a predetermined distance from the inner surface of the case cap so that the clutch protrusion selectively contacts the contact part and at least one fixing part that projects outwardly and is inserted into the recessed portion of the holding part to prevent the clutch ring from idling within the holding part.

2. The hinge device for a refrigerator of claim 1, further comprising at least one compression spring provided within the case that supplies elasticity to dampen the at least one rotation shaft in a predetermined section to the at least one rotation shaft.

3. The hinge device for a refrigerator of claim 1, further comprising a fastening part that extends from a lower portion of the case and is configured to be attached to the storage space.

4. The hinge device for a refrigerator of claim 2, wherein the clutch protrusion starts the contact with the clutch ring in an auto-closing section where the door is closed due to a load of the door, which is larger than the elasticity supplied by the at least one compression spring.

5. The hinge device for a refrigerator of claim 2, wherein the elasticity of the at least one compression spring balances equilibrium with a load of the door in a free-stop section where the door keeps on being stopped when it rotates upwardly or downwardly to be opened or closed, respectively.

6. The hinge device for a refrigerator of claim 5, further comprising at least one sliding member provided within the case, wherein opposite sides thereof contact the at least one rotation shaft and the at least one compression spring, respectively, to move forwardly or backwardly.

7. The hinge device for a refrigerator of claim 6, wherein at least one sliding recess is formed on an inner surface of the case in a longitudinal direction to guide the forward and backward motion of the at least one sliding member, and wherein at least one sliding protrusion corresponding to the at least one sliding recess projects from the at least one sliding member.

8. The hinge device for a refrigerator of claim 6, wherein the at least one rotation shaft and the at least one sliding member are made of injection lubricative material which contains lubricant when being injection-molded.

9. The hinge device for a refrigerator of claim 6, wherein the at least one compression spring, the at least one sliding member, and the at least one rotation shaft comprise a pair of the compression springs, a pair of sliding members and a pair of rotation shafts arranged on both opposite sides from a center of the case, respectively.

10. The hinge device for a refrigerator of claim 6, wherein an engaging protrusion contacts each inner surface of the case and wherein the case cap projects outwardly on an outer surface of the at least one rotation shaft.

11. The hinge device for a refrigerator of claim 6, wherein a rotation supporting part extends in a shaft direction from a center of the at least one rotation shaft so that the at least one rotation shaft is not eccentric when rotating.

12. The hinge device for a refrigerator of claim 7, wherein a sliding cam projects from an inner surface of the at least one sliding member so that the at least one sliding member moves forwardly and backwardly due to the relative motion by the contact with the at least one rotation shaft, and wherein a shaft cam corresponding to the sliding cam is provided in a side of the at least one rotation shaft.

13. The hinge device for a refrigerator of claim 9, further comprising a supporting part within the case arranged hi the center of the case, wherein opposite sides thereof contact the pair of compression springs, respectively.

14. The hinge device for a refrigerator of claim 11, wherein a shaft fastening part extends in the shaft direction from the center of the rotation shaft opposite to the rotation supporting part of the at least one rotation shaft so that the at least one rotation shaft fastened to a side of the door rotates together with the door.

15. A refrigerator comprising a hinge device, which fastens a door thereto to open/close a storage space formed therein, the hinge device comprising: a case having a side opened to define an exterior thereof; at least one case cap fastened to the case to close the opened side of the case, the at least one case cap comprising a holding part recessed inwardly by a predetermined depth; at least one rotation shaft provided within the case, the at least one rotation shaft being fastened to a side of the door to rotate together with the door; a clutch protrusion that projects outwardly from a lateral surface of the at least one rotation shaft and having a predetermined curvature; and a clutch ring mounted within the case cap, the clutch ring being formed in a ring shape having a width corresponding to the recessed depth of the holding part and being made of an elastic material so that the clutch ring selectively contacts with the clutch protrusion to supply elasticity to the at least one rotation shaft during the rotation of the at least one rotation shaft, wherein the clutch ring comprises a contact part recessed away from an inner surface of the case cap on opposite sides of the clutch ring and spaced apart a predetermined distance from the inner surface of the case cap so that the clutch protrusion selectively contacts the contact part and at least one fixing part that projects outwardly and is inserted into the recessed portion of the holding part to prevent the clutch ring from idling within the holding part.

* * * * *